United States Patent [19]

Smith, Jr.

[11] 4,174,545

[45] Nov. 20, 1979

[54] TOILET STOOL VENTILATING DEVICE

[76] Inventor: Clarence E. Smith, Jr., 1372 E. 107th St., Los Angeles, Calif. 90002

[21] Appl. No.: 929,721

[22] Filed: Jul. 31, 1978

[51] Int. Cl.[2] ..... A47K 13/00; E03D 9/04

[52] U.S. Cl. ..... 4/217; 4/213

[58] Field of Search ..... 4/213, 217, 237, 234

[56] References Cited

U.S. PATENT DOCUMENTS

| | | | |
|---|---|---|---|
| 2,172,506 | 9/1939 | Gerger | 4/217 |
| 2,240,094 | 4/1941 | Foreman | 4/217 |

*Primary Examiner*—Henry K. Artis

*Attorney, Agent, or Firm*—Charles T. Silberberg

[57] ABSTRACT

A ventilating device for a toilet stool having a chamber means which fits the top of the bowl of the toilet. Within the chamber are a plurality of separate flow passages through which malodorous air within the bowl is drawn by a suction means which is connected to the plurality of flow passages. In this manner, odors are removed from the toilet bowl, preferably to a filtering apparatus.

2 Claims, 4 Drawing Figures

TOILET STOOL VENTILATING DEVICE

BACKGROUND OF THE INVENTION

This invention relates to a device for ventilating a toilet stool. More particularly, the invention relates to a device for removing malodorous air from a toilet stool.

Various kinds of toilet stool ventilating structures are already known. However, these systems have been subject to various disadvantages. Such devices are inefficient in operation, generally unsightly in appearance, costly to manufacture, and normally require specially designed toilet bowls and/or seats which are not readily adaptable to conventional toilet stool structures. Further, such devices have not been totally effective to withdraw all malodorous gases from the bowl and normally require expensive installation.

PRIOR ART STATEMENT

U.S. Pat. No. 3,533,112 to Poister discloses a toilet seat ventilating means in the form of an air chamber which is attached to the toilet seat. However, the air chamber is hollow rather than having separate flow passages. U.S. Pat. No. 2,172,506 to Gerger discloses a toilet seat ventilating attachment in the form of a collector chamber adapted to fit the top of the toilet bowl. While this patent does disclose the use of spaced walls within the hollow chamber to provide flow passages, such passages, rather than being separate, meet at a junction within the chamber. Such a design results in uneven suction through the different passages and can result in a clogging of all the passages by an obstruction in the junction within the chamber. Further, this design provides for suction at the front of the toilet seat when the ventilating device is in use rather than making such optional to the user.

SUMMARY OF THE INVENTION

It is, therefore, an object of the present invention to provide an efficient, practical, and inexpensive toilet stool ventilating device.

It is another object of the present invention to provide a toilet stool ventilating device overcoming the aforementioned disadvantages of the prior art devices.

It is yet another object of the present invention to provide a toilet stool ventilating device readily connectable to a conventional seat of a toilet bowl structure for the conveyance of air therefrom to a remotely located filter means by use of an air chamber means having separate flow passages.

Still another object of the present invention is to provide a toilet stool ventilating device which optionally, at the selection of the user, withdraws malodorous air from the front of the toilet bowl.

Briefly, in accordance with the invention, there is provided a ventilating device for a toilet stool which utilizes an air chamber means adapted to fit the top of the toilet bowl. The air chamber means is positioned between the toilet seat and bowl. The chamber means has an inner wall adjacent the enlarged opening of the toilet bowl which has a plurality of orifices spaced around the exterior of the inner wall to receive malodorous air from the bowl. A plurality of conduits in the chamber means are respectively connected to the orifices such that each conduit defines a separate flow passage from the associated orifice. A suction means connected by a conveying means to the plurality of conduits removes the malodorous air from the bowl. A switch means is operably connected to the suction means to selectively actuate the same.

Optimally, the ventilating device is also provided with a valve which is moveably secured in the chamber means. The valve has an inlet to receive air from the bowl. One of the conduits is connected to the valve. The valve is moveable to register the inlet and the conduit such that malodorous air from the bowl will be drawn therefrom into the valve and through the conduit by virtue of the suction means.

Other objects and advantages of the invention will become apparent upon reading the following detailed description and upon reference to the drawings.

While the invention will be described in connection with the preferred embodiment, it will be understood that it is not intended to limit the invention to that embodiment. On the contrary, it is intended to cover all alternatives, modifications, and equivalents that may be included within the spirit and scope of the invention as defined by the appended claims.

DETAILED DESCRIPTION OF THE INVENTION

Figure 1:
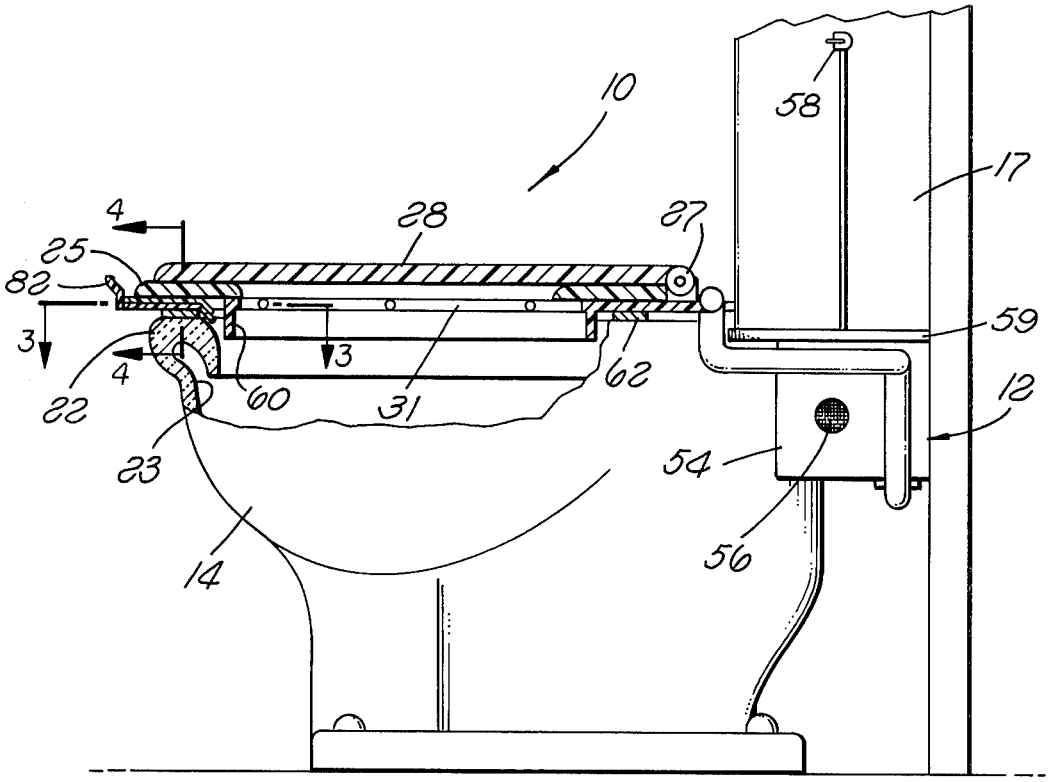
FIG. 1 is an elevational view of a toilet stool including the novel ventilating device of the present invention, with parts broken away and in section for use in understanding said invention.

Turning first to FIG. 1, there is shown an example of carrying out the present invention. A toilet stool structure, generally indicated at 10, is shown to have a toilet stool ventilating device generally indicated at 12 connected thereto. The toilet stool structure is substantially conventional having a toilet bowl 14 and a flushing tank 17 mounted on the rearward upper portion of the bowl 14 in an elevated relationship. The flushing tank 17 is provided with a handle member (not shown) operable in a conventional manner to release fluid from therewith to the toilet bowl 14 for flushing purposes. The toilet bowl 14 as is conventional is provided with water therein and an integral upper rim section 22 defining the periphery of an enlarged opening 23. A stool seat 25 is pivotally connected to the bowl 14 in an adjacent space relationship to the opening 23. The pivotal connection is provided by a hinge 27. A lid 28 may also be provided to cover toilet seat 25. Lid 28 is also connected to hinge 27 to allow pivotal movement thereof.

Figure 2:
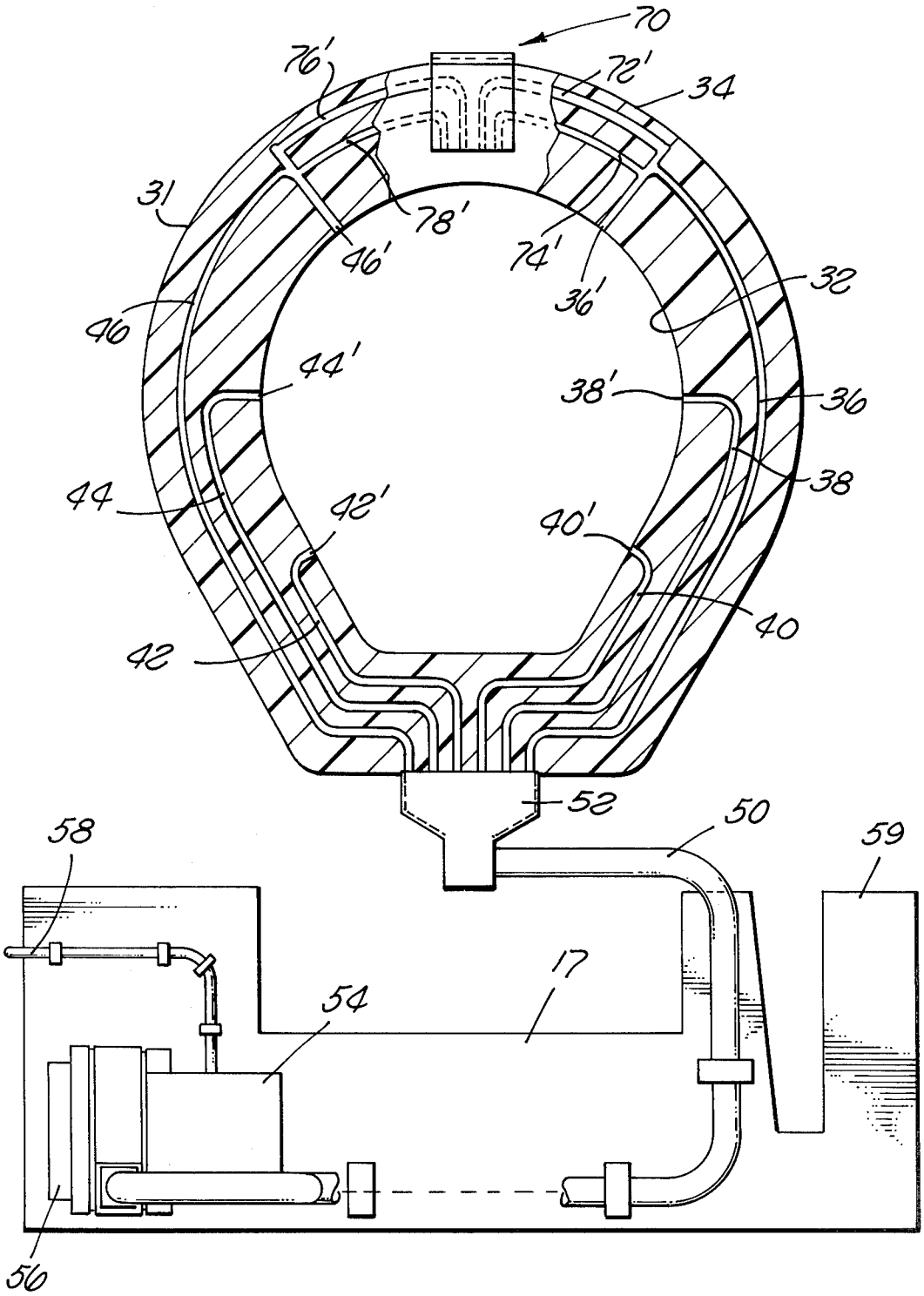
FIG. 2 is a plan view of the ventilating device of the present invention with the air chamber means shown in section.

With additional reference to FIG. 2, it is seen that toilet stool ventilating device 12 includes an air chamber means 31. Chamber means 31 is made of a suitable material, preferably plastic, shaped to substantially correspond with seat 25. Thus, air chamber means 31 is of a generally oval shape and rectangular in transverse cross section. Chamber means 31 is preferably fabricated by having two mating halves, each corresponding to that shown in FIG. 2. Air chamber means 31 has an inner wall 32 and outer wall 34. Inner wall 32 defines a central hole in chamber means 31 which substantially conforms with a similar hole in toilet seat 25. Outer wall 34 substantially conforms with the outer periphery of toilet seat 25.

Within air chamber means 31 are provided a plurality of conduits 36, 38, 40, 42, 44, and 46. These conduits can be formed by making grooves in the corresponding halves of chamber 31, which when placed together, form the conduits. To afford inlet of the odors from bowl 14 to the collector chamber 31, the latter is provided with a plurality of apertures 36', 38', 40', 42', 44', and 46' spaced around the exterior of the inner wall 32. Each of these apertures is associated with one of the conduits and is numbered accordingly. Thus conduit 46 is associated with aperture 46'. By virtue of such connection, each conduit defines a separate flow passage from the associated orifice such that air is drawn from bowl 14 through separate passages in the chamber means 31. Accordingly, no central collector space or junction of the conduits is provided in chamber 31. This avoids clogging due to obstructions which may result in the junction and results in more even distribution of the vacuum. Collector chamber 31 can also be provided with an inner rim 60 (FIG. 1) which serves as a baffle for directing all odorous fumes arising from the use of the toilet bowl 14 to the apertures in chamber means 31.

The conduits in chamber means 31 are connected through a line 50 and outlet connector 52 with a suitable exhauster means, such as the remotely located electrically operable suction fan 54. Preferably, a filter 56 is also connected to suction fan 54 such that the malodorous air which flows through line 50 from the conduits and chamber means 31 passes to the atmosphere through filter 56 with the odor thereby eliminated. A switch 58 is provided to activate motor 54 such that the user can utilize the ventilating device 12 only when desired or necessary. Line 50, motor 54, filter 56, and switch 58 of ventilating device 12 can be mounted to tank 17 such as by connection to a support plate 59 mounted to tank 17 such that the switch is accessible to the user and the line 50, motor 54, and filter 56 are substantially hidden and do not take up additional space.

As shown in FIG. 1, chamber means 31 is mounted between the undersurface of stool seat 25 and rim 22 of toilet bowl 14. Chamber means 31 is preferably mounted to seat 25 in any suitable manner, as by a plurality of mounting screws, but could alternatively be attached to rim 22 of bowl 14. As illustrated, the underside of chamber means 31 is fitted with a rubber sealing element 62 for engagement with rim 22 of bowl 14. When chamber means 31 is to be attached to rim 22, sealing strip 62 can be attached to rim 22 by use of a suitable glue, by a magnetic technique, or simply fit mechanically around the rim.

Optimally, a valve 70 is provided in the front of air chamber means 31. Valve 70 is slidably positionable within a slot provided in air chamber means 31. Valve 70 is a rectangular member having a plurality of flow passages 72, 74, 76, and 78 provided therein. Each of the flow passages in the valve 70 terminate at the rear end of valve 70 at a downwardly extending lip 80. A handle is provided on the front end of valve 70 such that the position of valve 70 can be controlled by the user of the ventilating device 12. As can most clearly be seen in FIGS. 3 and 4, valve 70 has two longitudinally extending grooves 84 and 86. Grooves 84 and 86 are designed to mate with tongues 88 and 90, respectively, which form a part of chamber means 31. This tongue and groove connection allows for the sliding movement of valve 70 within chamber means 31.

When valve 70 is provided in chamber means 31, there are provided additional conduits 72', 74', 76', and 78'. Conduits 72', 74', 76', and 78' can each be separate conduits which would individually be connected to line 50 through connector 52 as with conduits 36, 38, 40, 42, 44, and 46. Alternatively, conduits 76' and 78' can be connected to conduit 46 and conduits 72' and 74' can be connected to conduit 36.

Figure 3:
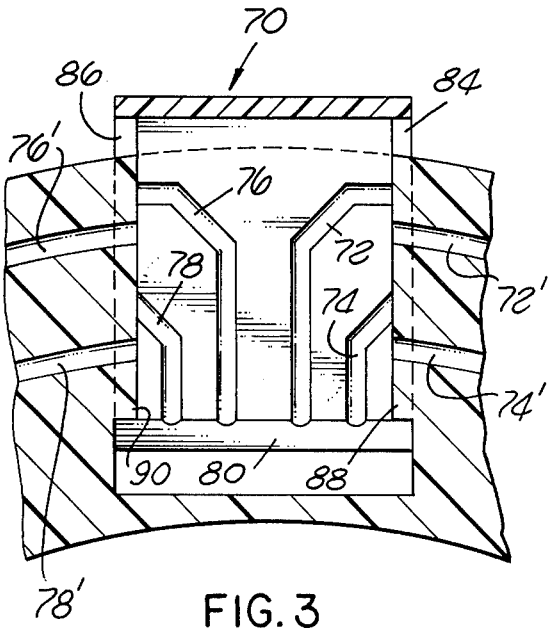
FIG. 3 is an enlarged fragmentary sectional view of the moveable valve of the present ventilating device taken in the direction of arrows 3—3 of FIG. 1.
Figure 4:
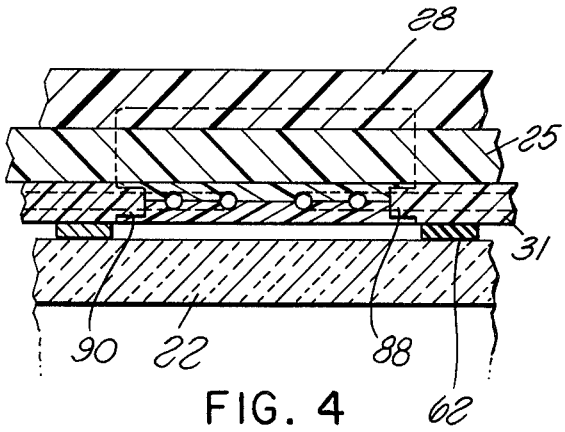
FIG. 4 is an enlarged fragmentary sectional view taken in the direction of arrows 4—4 of FIG. 1.

As can be seen in FIGS. 2 and 3, valve 70 can be positioned to have the passages in valve 70 selectively register with corresponding conduits. Thus, as seen in FIG. 2, when valve 70 is positioned to register its passages with corresponding conduits, passage 76 would be registered with conduit 76', passage 72 with 72', etc. In this position, malodorous air from bowl 14 could be drawn up through valve 70 by passing over lip 80 into the flow passages of valve 70 and through the corresponding conduits into chamber means 31. Thus, when motor 54 is actuated, air from the front of bowl 14 would be extracted. This would normally be desired by the user to insure removal of all malodorous odors. However, valve 70 can be positioned such as shown in FIG. 3 where the flow passages of valve 70 are out of registration or alignment with the corresponding conduits such that there is no suction in the front of chamber means 31 and toilet seat 25. Rather, the suction would only be applied through apertures 36, 38, 40, 42, 44, and 46. This may be desired by the user of the device because depending upon that person's size, gender, etc. it may be undesirable to have suction applied at that area.

Thus, it is apparent that there has been provided, in accordance with the invention, a dispensing device that fully satisfies the objectives, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations which fall within the spirit and scope of the appended claims.

What is claimed is:

1. A ventilating device for a toilet stool having a toilet bowl and a seat pivotally connected thereto, said bowl having an enlarged opening, comprising:

an air chamber means adapted to fit the top of said bowl and positioned between said seat and said bowl, said chamber means having an inner wall adjacent said enlarged opening, said inner wall having a plurality of orifices spaced around the exterior thereof to receive air from said bowl, said chamber means having a plurality of conduits therein, said conduits being respectively connected to said orifices such that each conduit defines a separate flow passage from the associated orifice;

discharge connector means connected to said conduits for receiving air discharged from said conduits;

suction means for removing air from said bowl to remove odors therefrom;

conveying means connecting said suction means and said discharge connector means for conveying air from said chamber means to said suction means;

a valve moveably secured in said chamber means, said valve having an inlet to receive air from said bowl, said valve being connected to one of said conduits, said valve being positionable to register said inlet and said one of said conduits to allow flow of air from said bowl into said chamber means and to move said inlet out of registration with said one of said conduits; and switch means operably connected to said suction means to selectively actuate said suction means.

2. A ventilating device for a toilet stool having a toilet bowl and a seat pivotally connected thereto, said bowl having an enlarged opening, comprising:

an air chamber means adapted to fit the top of said bowl and positioned between said seat and said bowl, said chamber means having an inner wall adjacent said enlarged opening, said inner wall having a plurality of orifices spaced around the exterior thereof to receive air from said bowl, said chamber means having a plurality of conduits therein, said chamber means having a passage therein, said conduits being respectively connected to said orifices such that each conduit defines a separate flow passage from the associated orifice;

a valve moveably secured in said chamber means, said valve having an inlet to receive air from said bowl, said passage being connected to said valve, said valve being positionable to register said inlet and said passage to allow flow of air from said bowl into said passage and to move said inlet out of registration with said passage;

discharge connector means connected to said conduits and said passage for receiving air discharged from said conduits and said passage;

suction means for removing air from said bowl to remove odors therefrom;

conveying means connecting said suction means and said discharge connector means for conveying air from said chamber means to said suction means; and switch means operably connected to said suction means to selectively actuate said suction means.

* * * * *